US006883942B2

(12) United States Patent
Denningham

(10) Patent No.: US 6,883,942 B2
(45) Date of Patent: Apr. 26, 2005

(54) CORNER FLOOR LAMP AND PRINCIPLES OF DESIGN

(76) Inventor: Robert Louis Denningham, 917 Eastham Ct., #14, Crofton, MD (US) 21114

( * ) Notice: Subject to any disclaimer, the term of this patent is extended or adjusted under 35 U.S.C. 154(b) by 263 days.

(21) Appl. No.: 10/227,795

(22) Filed: Aug. 27, 2002

(65) Prior Publication Data

US 2004/0047157 A1 Mar. 11, 2004

(51) Int. Cl.[7] ..... F21S 8/03
(52) U.S. Cl. ..... 362/414; 362/410; D26/93
(58) Field of Search ..... 362/410, 414, 362/427, 430, 431; D26/93, 105, 106, 107

(56) References Cited

U.S. PATENT DOCUMENTS

| | | | | |
|---|---|---|---|---|
| 2,694,137 | A | | 11/1954 | Williams |
| 5,381,326 | A | | 1/1995 | Yeh |
| D375,380 | S | * | 11/1996 | Lewis ..... D26/111 |
| D411,024 | S | | 6/1999 | Schaak et al. |
| D433,531 | S | | 11/2000 | Hsu |
| D434,870 | S | | 12/2000 | Hsu |
| D435,931 | S | | 1/2001 | Yeh |
| D437,078 | S | | 1/2001 | Chen |
| D439,006 | S | | 3/2001 | Yeh |
| D448,107 | S | | 9/2001 | Swanson |
| D453,235 | S | | 1/2002 | Hsu |
| D453,391 | S | | 2/2002 | Hsu |

* cited by examiner

*Primary Examiner*—Sandra O'Shea
*Assistant Examiner*—Ali Alavi

(57) ABSTRACT

A floor lamp that economizes floor space and illuminates and enhances the corner of a room, the functional and ornamental design of which is based on symmetry considerations dictated by the three-dimensional geometry of the corner. The footprint of the lamp base has two sides that form a ninety-degree angle for flush insertion in the corner. A post or other structure attached at its lower end to the base supports a luminaire at its furthest end. The base, post or support structure and luminaire are either symmetric with respect to a vertical plane that bisects the ninety-degree angle of the base, or exhibit balanced asymmetry with respect to the said bisecting plane, as understood by persons skilled in the art. Rectangular lamp bases are excluded by failure either to economize floor space or to meet the above symmetry requirements.

5 Claims, 5 Drawing Sheets

CORNER FLOOR LAMP AND PRINCIPLES OF DESIGN

BACKGROUND OF THE INVENTION

1. Field of the Invention

This invention relates to lighting fixtures, and more particularly to a novel concept of a corner floor lamp, and the design principles related to achieving aesthetically pleasing corner floor lamps.

2. Description of the Related Art

Many configurations of floor lamps are currently available. However, a search of the prior art does not disclose any patents that read directly on the claims of the instant invention. Nor does any art prior to the applicant's above-cited patent suggest, or recognize as a design option, a floor lamp intended for exclusive placement in the corner of a room.

Williams, in U.S. Pat. No. 2,694,137, describes a lighting fixture having a substantially planar, square sheet metal base, with a configuration that conforms to the corner of a showcase. A light bulb or the like is attached to the base at its lower end. Williams' requirement of a planar base, consistent with the desirability of a low-profile, inconspicuous lighting fixture in a showcase, distinguishes itself from the instant invention, where a visibly attractive appearance of the base is desirable. That an aesthetically pleasing appearance is not an object of Williams' invention is exemplified by its unadorned planar base, where functional artifacts, such as screw holes and a flat spring, are left unobscured. Thus Williams' base is not adaptable to the aeshetic object of the instant corner floor lamp, nor does it provide an impetus for the instant invention.

Inasmuch as a householder may desire to place a conventional floor lamp in the corner of a room, the limitations of such usage are germane to the instant application. Some conventional floor lamps have substantially vertical posts or support structures that are attached to the center of a base. Such bases can be circular, ovally or rectangular. Alternatively, the floor lamp may be supported on legs that are symmetrically placed about the post or support structure. All such bases preclude the snug placement of floor lamps in the corner of a room. If, for example, the shades of the lamps are wider than the base, as is typically the case, the shade, being centered over the base, makes contact with the walls before the base does, thus preventing placement of the lamp deep in the corner of a room.

Some floor lamps with circular bases have posts or support structures that are directed away from the vertical in their upper lengths, thus allowing suspension of the luminaire further from the corner as compared to a fully vertical post or support structure. However, the bases of these lamps still cannot be placed deep in the corner of a room due to the mismatch of their contours with the ninety-degree angle of the corner.

Also available are floor lamps with rectangular bases, some of which have luminaires suspended off-center as described above. However, the off-center displacement of the luminaire is parallel to a pair of sides of the base, hence the luminaire is not suspended in the open space of the corner, but along one of the walls. Moreover, the width of the shade of the luminaire is typically greater than that of the base, which precludes placement of the base snugly in the corner of a room.

If a rectangular base is square, and the luminaire is directly above the center of the base, the sides of the base must be equal to or greater than the diameter of the luminaire to keep the luminaire a minimum of ½ inch from making contact with the walls. (The ½ inch space is provided by a baseboard that is typically ½ inch in width.) A diagonal of the base will be longer than the diameter of the luminaire by a factor of 1.4. Large luminaires will require correspondingly large bases with long diagonals extending into the space of which it is an object of the present invention to economize. Alternatively, the size of a luminaire can be reduced to accommodate a small square base. However, such manipulation of dimensions confines artistic expression and engineering options, and is not a prescription for the design of corner floor lamps.

Thus, a floor lamp intended for exclusive use in the corner of a room is not found in the prior art. This absence of an exclusive corner floor lamp speaks to the lack of motivation and/or desirability for such an invention in the prior art. Conventional floor lamps that may be placed in the corner of a room do not make efficient use of floor space that may be restricted by household furnishings such as chairs, sofas, tables, etc. Nor is it an object of conventional floor lamps to present an aesthetically pleasing appearance in the corner of a room.

Special considerations guide the design of a furnishing that is destined for exclusive placement in the corner of a room. Symmetry is an important aspect of design, and the distinct symmetry of the corner of a room must be taken into account. Beyond the peculiar symmetry of the corner of a room, is the fact that a furnishing designed for a corner of a room has a front and back, as compared to a furnishing that may be viewed all around. Conventional floor lamps are not designed to be in harmony with the spatial geometry of the corner of a room.

The walls that form a corner are symmetric with respect to a vertical plane that bisects the ninety-degree angle of the corner. Typically, the design of an aesthetically pleasing furnishing in the corner will be symmetric with respect to the bisecting plane. Where the design is asymmetric with respect to the bisecting plane, the asymmetry may be informally balanced to achieve an aesthetically pleasing result. These considerations of symmetry will generally not succeed in producing an aesthetic result when applied to a conventional floor lamp, where the angular view is 360 degrees.

3. Objects of the Invention

The principle object of the instant invention is the disclosure of principles for the design of aesthetically pleasing floor lamps in accordance with the above-stated symmetry considerations, that are intended for exclusive placement in the corner of a room.

Another object is to provide a floor lamp that economizes the space in the corner of a room.

Still another object is provision of a base for a corner floor lamp, where said base may be non-planar, and composed of, but not limited to, a metal that is susceptible to manufacturing processes such as stamping, casting, forging, spinning, or other processes to achieve aesthetically pleasing design objectives.

Another object is to provide a corner floor lamp supported by a multiplicity of legs.

Yet another object of the invention is the provision of a corner floor lamp with an up-lighting luminaire, supported at the upper end of a post or other support structure, to provide both direct illumination, and indirect, diffuse illumination reflected from the surfaces of a room.

A further object is the provision of a down-lighting corner floor lamp, wherein a down-lighting luminaire is suspended by a bridge attached to the upper part of a post or support structure, the bridge being in the bisecting plane and directed away from the corner. In the alternative, the luminaire may be suspended at the end of a post or support structure, the upper length of which may be curved, such as a gooseneck, or otherwise directed away from the corner.

BRIEF SUMMARY OF THE INVENTION

The instant invention adheres to the symmetry principles stated above. It comprises a base having two edges, which may be substantially non-planar, that form a ninety-degree angle for snug placement in the corner of a room. Alternatively, the base may consist of a multiplicity of legs, the footprints of at least three of which form a ninety degree angle. A post or other support structure, symmetric with respect to the vertical bisecting plane of the corner, or in calculated asymmetry (informal balance) with the bisecting plane, is attached at its lower end to the base. A luminaire is attached to the upper end of the post or other support structure.

BRIEF DESCRIPTION OF DRAWINGS

For the purpose of illustrating the invention, there are shown in the accompanying drawings representative embodiments of corner floor lamps that exhibit the principles of the instant invention, it being understood that the invention is not intended to be limited to the embodiments shown.

DETAILED DESCRIPTION OF THE INVENTION

Figure 1:
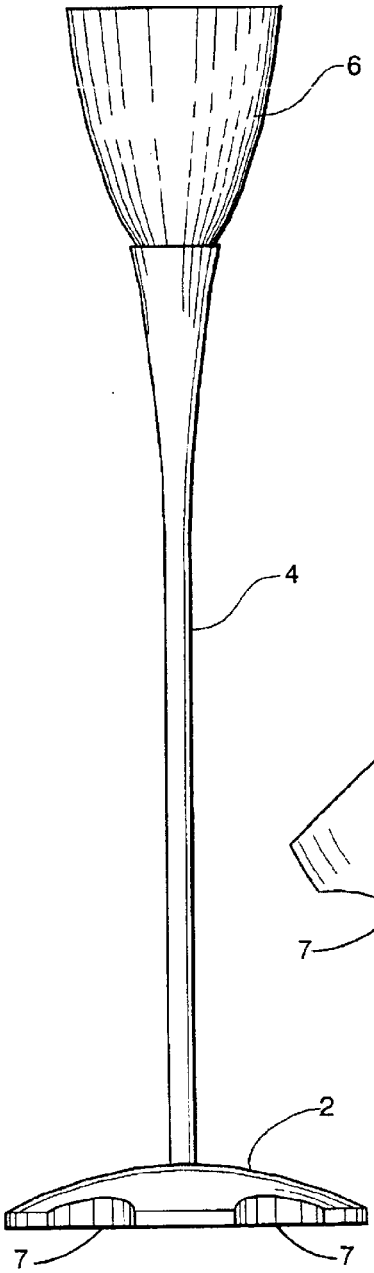
FIG. 1 is a front elevation view of an embodiment of the up-lighting corner floor lamp.
Figure 3:
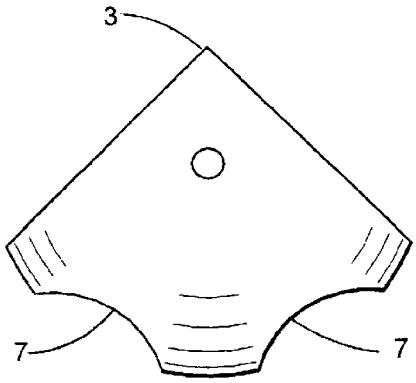
FIG. 3 is a top plan view of the base of FIG. 1.
Figure 2:
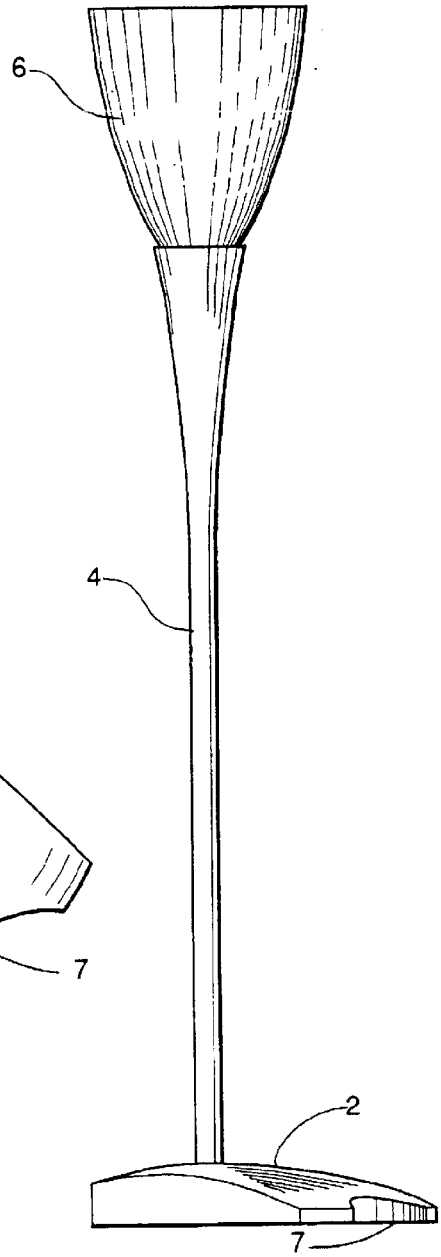
FIG. 2 is a side elevation view of the up-lighting corner floor lamp of FIG. 1.

Referring to FIGS. 1 and 2, an up-lighting luminaire 6, is supported by a column 4 attached to base 2. FIG. 3 shows the base in plan view with vertex 3 that forms the ninety-degree angle for snug placement in the corner of a room. The embodiment of FIGS. 1 and 2 exemplifies a corner floor lamp that is symmetric with respect to the vertical plane that bisects the vertex angle of the base, and hence the ninety-degree angle in the corner of a room. Ornamental designs 7, symmetrically placed with respect to the bisector of the corner angle, illustrate a design solution that is in harmony with the spatial geometry of the corner of a room.

Figure 4:
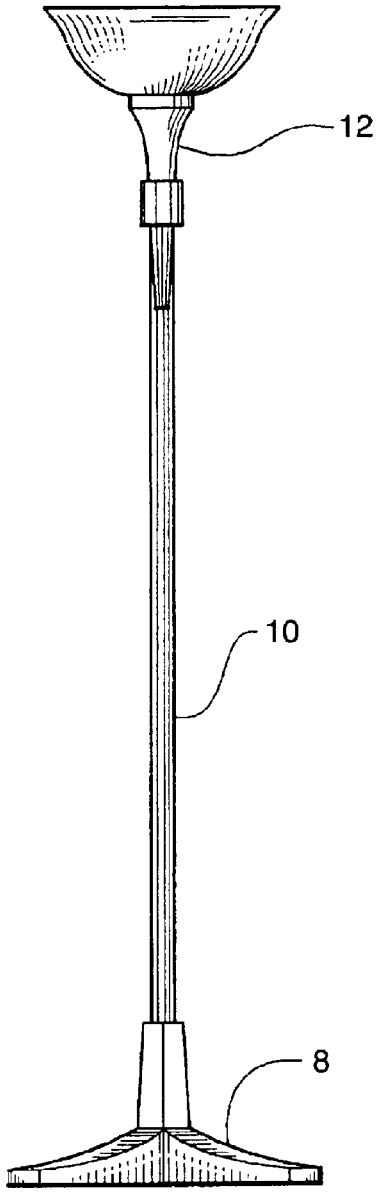
FIG. 4 is a front elevation view of another embodiment of the up-lighting corner floor lamp.
Figure 6:
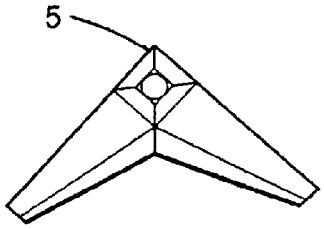
FIG. 6 is a top plan view of the base of FIG. 4.
Figure 5:
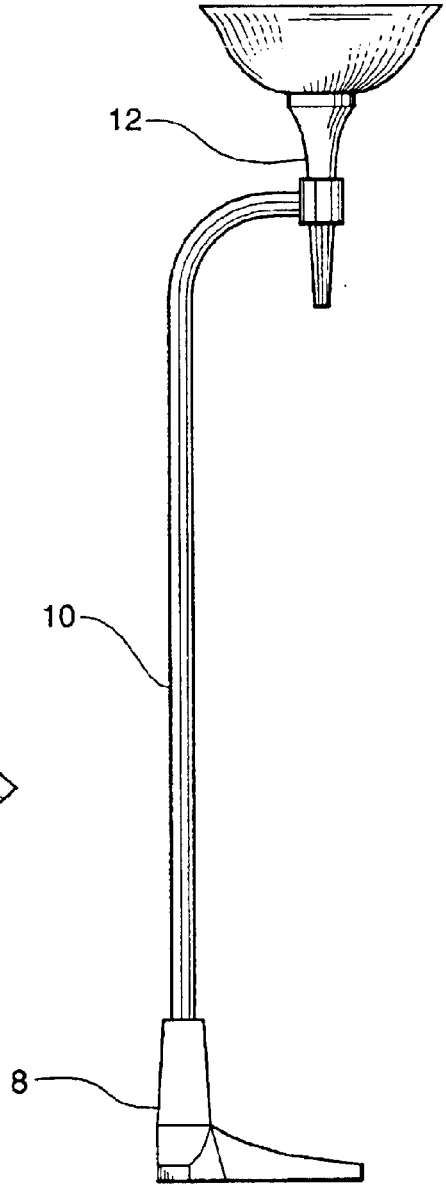
FIG. 5 is a side elevation view of the corner floor lamp of FIG. 4.

FIGS. 4 and 5 show another embodiment of a symmetric, up-lighting corner floor lamp. Support column 10 attached to base 8, curves away from the vertex 5 of the ninety-degree angle of the base, FIG. 6, the curvature being in the vertical bisecting plane of the vertex. An up-lighting luminaire 12 is attached to the end of the curved column. Base 8, column 10 and luminaire 12 are symmetric with respect to the vertical plane that bisects the vertex angle 5 of the base. The plan view of the base, FIG. 6, with its minimal footprint, illustrates the space saving property of such a base.

Stability of the lamp is provided by the length of the legs of base 8. The length of the legs is calculated to oppose the torque exerted on the base by the overhead weight of the horizontal extension of the column and the luminaire. A static equilibrium is established when the center of mass of the floor lamp is inside a line that connects the tips of the legs.

Figure 7:
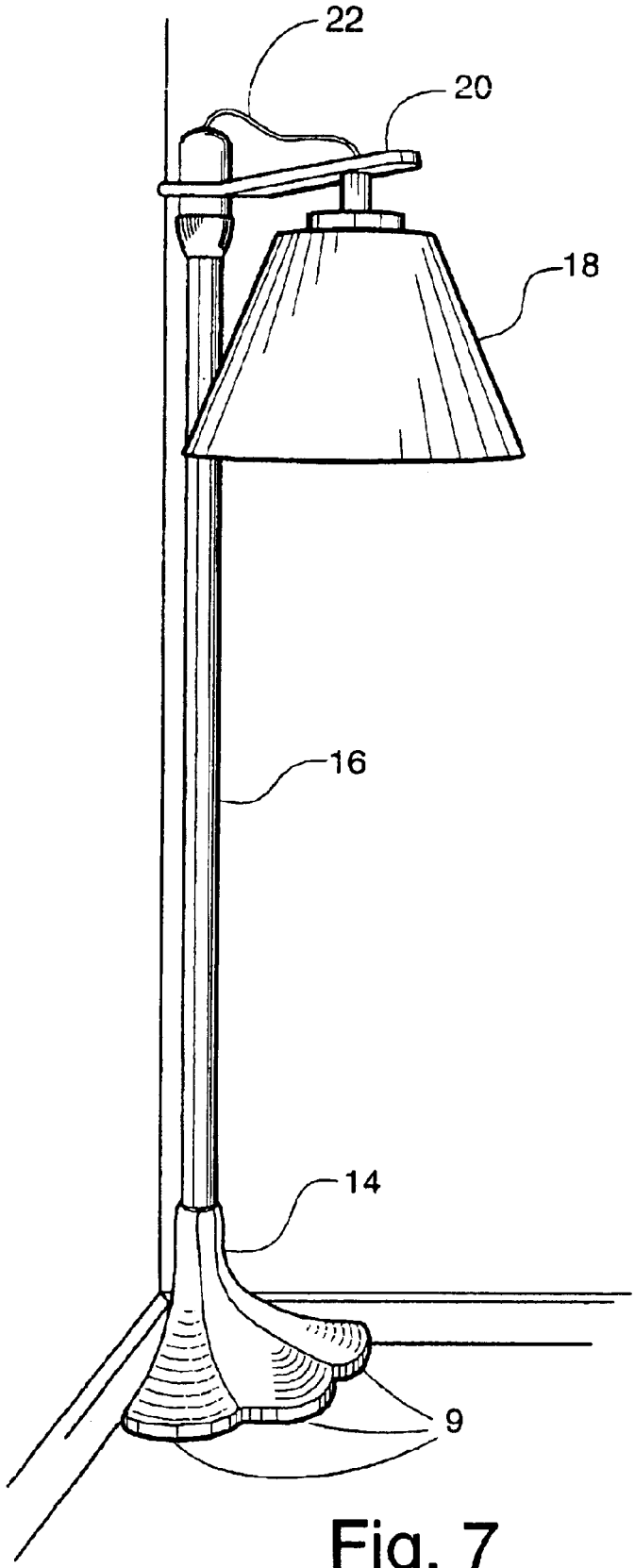
FIG. 7 is a side perspective view of an embodiment of a down-lighting corner floor lamp.

FIG. 7 illustrates a symmetric embodiment of a down-lighting corner floor lamp. A support column 16 is attached at its lower end to base 14. A bridge 20, attached to column 16 near its upper end, supports a down-lighting luminaire 18. An electrical conductor 22 passes through the bridge 20 to the luminaire 18. Referring to the base of FIG. 7, ornamental lobes 9 display symmetry with respect to the bisecting plane of the corner, wherein the central lobe is bisected by the plane, and the side lobes are symmetrically spaced on each side of the plane. In like manner, column 16, bridge 20 and luminaire 18 are symmetric with respect to the bisecting plane. Static equilibrium of the lamp is established when its center of mass is within the vertically extended projection of the footprint of the base.

Figure 8:
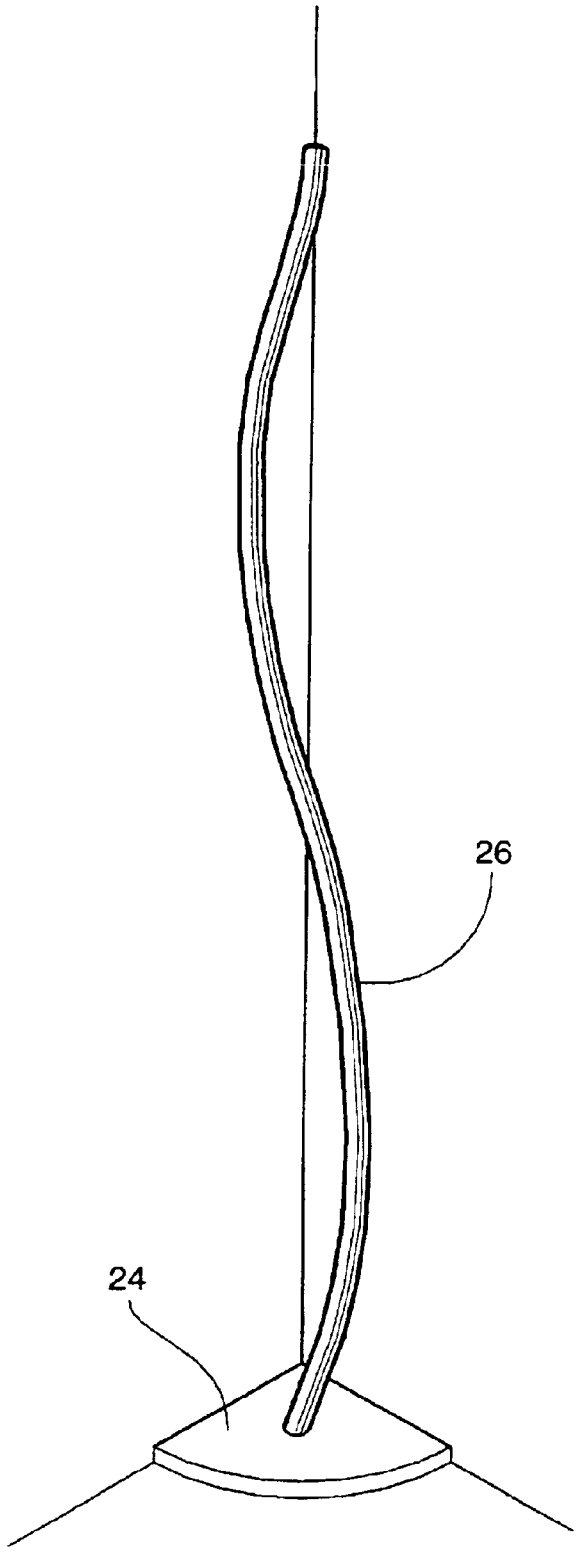
FIG. 8 is a front perspective view of the base and post of a corner floor lamp, wherein the post is asymmetric with respect to the plane that bisects the vertex angle of the base.

FIG. 8 illustrates an asymmetric configuration of a corner base 24 and column 26 which may be used to support a luminaire. Column 26 may be thought to begin at the base in the plane of the bisector. It proceeds from the base to undulate through the plane at mid-height, then returns to the plane at the top. This completion of a cycle of undulation, starting and ending in the bisecting plane, and the spatial balance it achieves about the plane, resolves the tension of the asymmetry of the column with respect to the bisecting plane.

Figure 9:
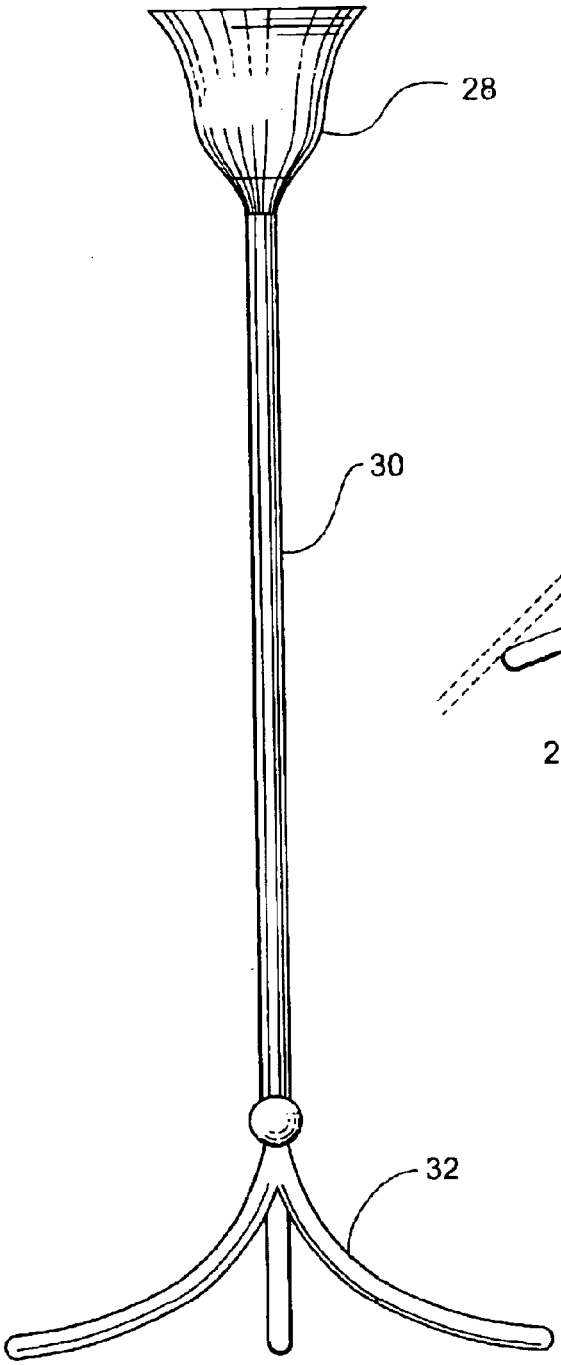
FIG. 9 illustrates a corner floor lamp supported by three legs.
Figure 10:
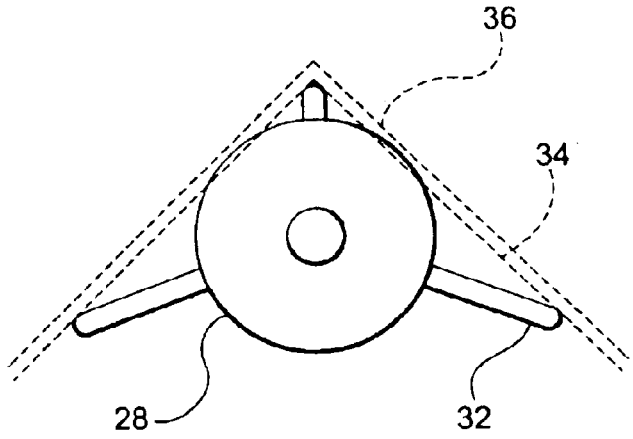
FIG. 10 is a top plan view of the floor lamp of FIG. 9, with dashed lines indicating the width of a baseboard in the corner of a room.

Referring to FIG. 9, a floor lamp comprising a luminaire 28, post 30 and three-legged base 32, illustrates a particular embodiment of a corner floor lamp that is supported by a multilicity of legs. FIG. 10, a top plan view of the floor lamp of FIG. 9, shows the arrangement of the legs 32. Dashed lines 34 and 36 represent the inner border of a baseboard and the interface of the baseboard with a wall, respectively. The luminaire 28 may extend beyond the vertical plane defined by the inner border of the baseboard 34 before making contact with the wall 36, as shown. The supporting legs 32 are symmetrically arranged within the ninety-degree corner to form an isosceles triangle. A multiple-legged floor lamp having more than three legs would have three of its leas arranged as in FIG. 10. The arrangement of additional legs would be guided by the symmetry principles disclosed in the instant invention.

It is to be understood that configurations of the instant invention are not limited to the embodiments shown, and that persons skilled in the art may create variations thereof without departing from the principles disclosed herein.

What is claimed is:

1. A floor lamp comprising:

a non-rectangular base, the rear footprint of which is delimited by two straight edges, said straight edges meeting at a ninety-degree angle in the horizontal plane;

a post or other structure secured to the base, which post or other structure may be entirely vertical or deviate therefrom;

a luminaire secured to the upper end of the post or other structure;

the entire assembly being symmetric, or in informal balance with, the vertical bisecting plane of the ninety-degree angle of the base, as understood by persons skilled in the art.

2. A floor lamp as in claim 1 wherein the base is substantially non-planar.

3. A floor lamp as in claim 1 wherein the base is substantially planar.

4. A floor lamp as in claim 1 wherein the base consists substantially of two elongated feet forming a ninety-degree angle at the rear of the base.

5. A floor lamp comprising:

a base or support structure that may consist of a multiplicity of legs, wherein the tips of three of the legs mark the points of an isosceles triangle; the vertex of said isosceles triangle being a ninety-degree angle, a luminaire supported by a post or support structure;

the entire assembly being symmetric, or in informal balance with, the vertical bisecting plane of the ninety-degree angle of the base, as understood by persons skilled in the art.

* * * * *